US005895687A

United States Patent [19]

Kondo et al.

[11] Patent Number: 5,895,687

[45] **Date of Patent: *Apr. 20, 1999**

[54] METHOD FOR COATING A SUBSTRATE USING INCLINED EDGE GUIDES

[75] Inventors: Yoshikazu Kondo; Koji Fukazawa; Akira Nishiwaki, all of Hino, Japan

[73] Assignee: Konica Corporation, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/823,882

[22] Filed: Mar. 17, 1997

[30] Foreign Application Priority Data

Mar. 21, 1996 [JP] Japan ..... 8-064417

[51] Int. Cl.[6] ..... B05D 1/30; B05C 5/00

[52] U.S. Cl. ..... 427/420; 118/324; 118/DIG. 4

[58] Field of Search ..... 427/420; 118/DIG. 4, 118/324

[56] References Cited

U.S. PATENT DOCUMENTS 4,135,477 1/1979 Ridley ..... 427/420

4,647,482 3/1987 Degrauwe et al. ..... 427/420

4,830,887 5/1989 Reiter ..... 427/420

FOREIGN PATENT DOCUMENTS 0 537 086 A1 4/1993 European Pat. Off. .

*Primary Examiner*—Katherine A. Bareford

*Attorney, Agent, or Firm*—Jordan B. Bierman; Bierman, Muserlian and Lucas

[57] ABSTRACT

A method for producing a light-sensitive material. The method includes the steps of: discharging coating solution, including the light-sensitive material, from a coater die; forming a curtain layer of coating solution by causing the coating solution to fall from a die lip of the coater die in which the curtain layer is formed with an edge guide in which an end of the edge guide is arranged in the vicinity of the die lip and the other end of the edge guide is inclined toward the coater die in relation to the vertical line from the die lip; and coating a support with the coating solution by conveying the support at the downstream end of the curtain layer.

7 Claims, 6 Drawing Sheets

METHOD FOR COATING A SUBSTRATE USING INCLINED EDGE GUIDES

BACKGROUND OF THE INVENTION

The present invention relates to a technology to stabilize a curtain coater employing a curtain coating method, and in particular, to a technology to form a curtain layer stably.

There has been known a curtain coating method wherein a coating solution flowing down along a slide surface of a coater die in a form of a uniform layer is caused to fall from a tip of a die lip of the coater die to be formed into a thin curtain layer of coating solution which is, then, put continuously on a web of a long support while the support is running at a certain high speed for coating. In a coating apparatus manufacturing a light-sensitive material by the use of the curtain coating method mentioned above, it is very important that a curtain layer is formed in a stable manner. It has been cleared that a teapot phenomenon is remarkable, and that phenomenon sometimes caused a curtain layer not to be formed at a bottom end portion of an edge guide (skipped curtain layer) especially in a system wherein a quantity of a coating solution is large. The teapot phenomenon is one wherein with regard to a coating solution which flows down along the slide surface and is just about to fall from the tip of a die lip, a curtain layer does not fall in the vertical direction due to a flow speed of coating solution varying at each point in the direction of a flowing layer thickness, but it falls while it is curved toward the die. Various inventions which will be stated below have been achieved, for improving the skipped curtain layer mentioned above.

Namely, Japanese Patent Publication Open to Public Inspection No. 99668/1989 (hereinafter referred to as Japanese Patent O.P.I. Publication) discloses a means to strengthen and stabilize a curtain layer by causing side solutions to flow additionally on end portions at both sides for improving the foregoing by preventing the skipped curtain layer. In this means, however, the side solution is accumulated on each end portion intensively, resulting in an excessive thick layer on each of both sides, although the curtain layer is not skipped.

For the intent of inhibiting the increase in a layer thickness on each side, a thick layer portion on an end portion of a curtain layer is removed through attraction, as disclosed in Japanese Patent O.P.I. Publication Nos. 477/1986 and 233954/1994.

In Japanese Patent O.P.I. Publication No. 57734/1976, a curtain layer is stabilized by the use of a flat plate type edge guide. However, even this method can not solve the phenomenon of thick layers at both edges.

(Problems to be solved by the invention)

In the case of the means to strengthen and stabilize a curtain layer by causing side solutions to flow on edge portions of both sides as stated above, side solutions are accumulated intensively at edge portions on both sides of a coating surface, resulting in increased layer thickness at both sides which applies greater load on a drying process.

When taking a means of attraction on both sides as stated above for solving the problem mentioned above, an expense for installation of facilities and a load for maintenance expense are increased, and a cost of coating solutions equivalent to those removed at end portions is also increased.

Further, separately from the foregoing, when using the flat plate type edge guide, it stabilizes a curtain layer no doubt, but a layer thickness on the side of a curtain layer is increased to create a thick layer because an area of contact between the flat plate type edge guide and a coating solution is increased, which results in greater load on a drying process and in reduction in an effective width for a product.

Namely, as far as the inventions mentioned above are concerned, a curtain layer can be stabilized to a certain extent, but an area of contact between a coating solution and an edge guide is increased and edge portions are made to be uneven accordingly, in any case of the inventions mentioned above. Therefore, a load for drying thick layer portions is caused and sufficient uniform coating necessary for products can not be obtained, and in spite of the insufficient effect, installation of facilities and actions for the effect are needed, which has resulted in an increase in expenses. Accordingly, it has been required a method wherein the relation of the state of contact between an edge guide and a coating solution is investigated and a curtain layer can be stabilized.

SUMMARY OF THE INVENTION

An object of the invention is to provide a curtain coater wherein the problems in prior art mentioned above have been solved, and it is possible to manufacture a light-sensitive material having high quality and high yield while applying low load on a drying process, by coating with extremely uniform edge portions while forming a stable curtain layer through a curtain coating method.

The object mentioned above can be attained by either one of the following methods (1)–(5).

(1) A method for producing a light-sensitive material, including the steps of: discharging coating solution, including the light-sensitive material, from a coater die; forming a curtain layer of coating solution by causing the coating solution to fall from a die lip of the coater die in which the curtain layer is formed with an edge guide and an end of the edge guide is arranged in the vicinity of the die lip and the other end of the edge guide is inclined toward the coater die in relation to the vertical line from the die lip; and coating a support with the coating solution by conveying the support at the downstream end of the curtain layer.

(2) The method described in Item No. (1), in which discharging amount of the coating solution from the coater die is not less than 2 cc/sec./cm.

(3) The method described in Item No. (1), in which the edge guide is formed along a cross sectional shape of a curtain layer which is formed when the coating solution is fallen from the die lip without the edge guide.

(4) The method described in Item No. (3), in which the cross sectional shape is the teapot phenomenon shape.

(5) The method described in Item No. (1), in which a distance between the axial center of the edge guide and the longitudinal center at the downstream end of the curtain layer, which is formed when the coating solution is fallen from the die lip without the edge guide, is not more than ±4 mm in a direction perpendicular to the longitudinal direction of the curtain layer.

Namely, the inventors of the invention confirmed through experiments, after studying an improvement of a curtain coater in accordance with the object mentioned above, that the teapot phenomenon, in particular, becomes remarkable in the system where the total quantity of coating solution to be supplied is 2 cc/sec./cm or more and that the teapot phenomenon impedes formation of a curtain layer. Further, as a result of the study wherein an edge guide formed to be curved to follow each teapot phenomenon shape was prepared for each of the systems having different flow rates, it was cleared that stability of a curtain layer is improved much more by the curved edge guide than by an uncurved, straight and bar-shaped edge guide arranged vertically. In addition, even in the case of the straight and bar-shaped edge guide, it was found that stability of a curtain layer can be improved when the edge guide is arranged to be tilted so that the bottom end of the edge guide may be shifted toward a coater die to follow the teapot position. Since these methods can stabilize a curtain layer while keeping an area of contact between an edge guide and a coating solution to the minimum, they are considered to be far better than conventional methods employing an edge guide of a flat plate type of side coating solutions, on the point that edge portions of coated products are made uniform. Incidentally, these effects have been confirmed also by a shape (e.g., a flat plate type, a round type) of a section of the edge guide positioned on the side where the edge guide comes in contact with a curtain layer.

In curtain coating, it is very important that curtain layers are formed in a stable manner. Accordingly, therehave been applied many inventions concerning the matter mentioned above.

On the other hand, however, there exist various needs for an improvement in yield and for cost reduction, and therefore, edge portions of a curtain layer must be made uniform to the utmost extent. FIGS. 7 (A) through 7 (C) represent sectional views for edge guide 6 and curtain layer 7. Each of FIGS. 7 (A)–7 (C) shows an example wherein each edge guide is arranged to hang down vertically from a lip portion. With regard to each edge guide, a curtain layer can be formed no doubt more stably in (C) than in (A) and (B). However, edge portions of the coated layer are not uniform, which makes it impossible to secure a sufficient effective width for a product. In the case of (A) and (B), on the other hand, it is difficult to form a curtain layer in a stable manner, and the thinner an edge guide bar is in terms of thickness, the smaller an area of contact with liquid is, resulting in a more remarkable tendency toward the phenomena mentioned above. It is therefore necessary to have a technology which makes it possible to form a curtain layer in a stable manner even when the edge guide used is made thin to the utmost extent.

In the invention this time, therefore, a layer thickness on the edge portion can be uniform provided that an edge guide is within a range of 1.0–6.0 mm, and even when a thickness of the edge guide is lowered to a value (approx. 1 mm) equivalent mostly to the thickness of a layer flowing down to be a curtain layer, a curtain layer can be formed stably.

DETAILED DESCRIPTION OF THE INVENTION

Figure 1:
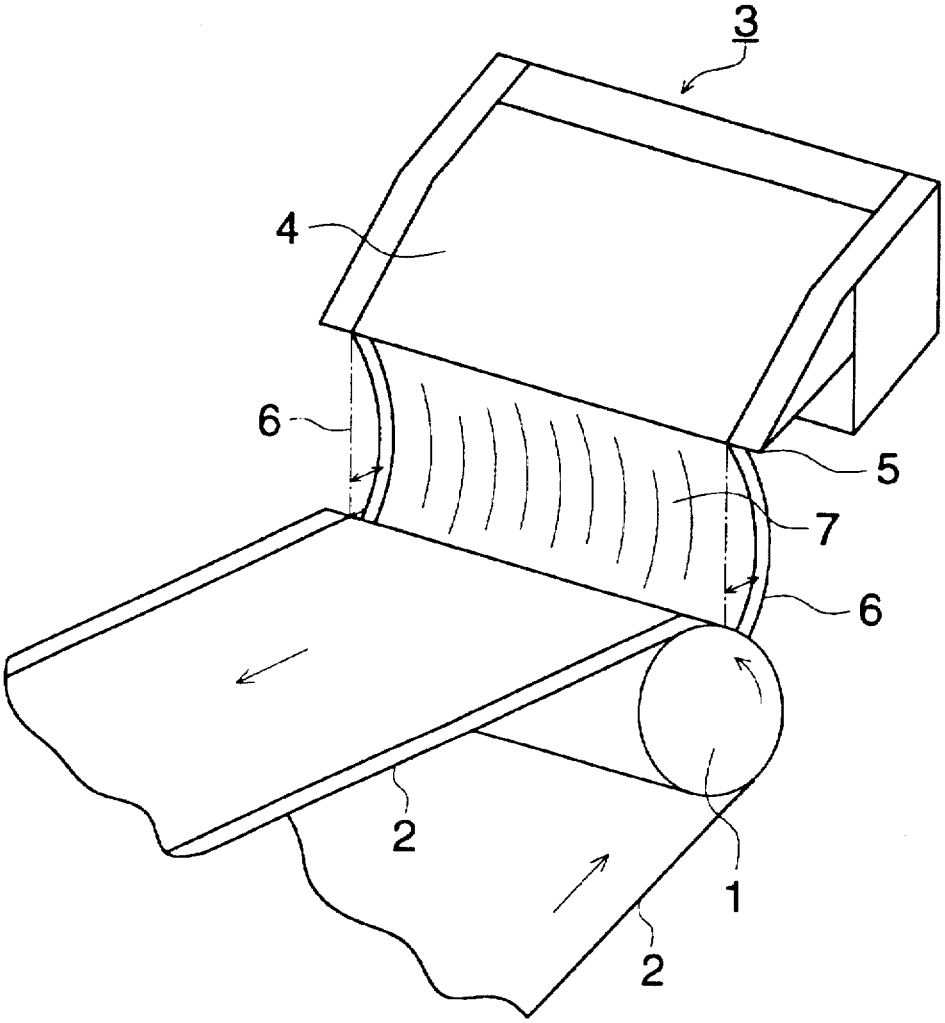
FIG. 1 is a perspective view of a curtain layer forming section in a curtain coater of the invention.

An embodiment of the invention will be explained as follows, referring to a perspective view in FIG. 1. Long support 2 is wound around back roller 1 so that the support can be conveyed in the arrowed direction at a constant speed. Coater die 3 is provided to be diagonal to the upper portion of the back roller 1, and plural layers of coating solutions, including light-sensitive material, are discharged from the coater die 3, flow down, while forming their uniform layer thicknesses, along slide surface 4 of the coater die 3 to the tip portion of die lip 5 of the coater die 3 where the plural layers leave the die lip 5 to fall while forming a thin curtain layer. In this case, both sides of the curtain layer are put on support 2 which is running at the constant speed while a uniform layer is being formed and maintained due to dynamic surface tension (DST) generated between edge guide 6 and the curtain layer, thus, continuous coating is achieved. In this case, the DST was measured in accordance with "A New Method of Measuring Dynamic Surface Tension" in Journal of Colloid and Interface Science, Vol.77 No.2 October 1980.

Figure 2A:
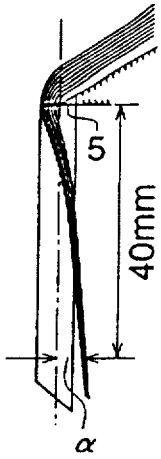
FIGS. 2(*a*), 2(*b*) and 2(*c*) each show a side view showing the relation between various edge guides and curtain layer forming.
Figure 2B:
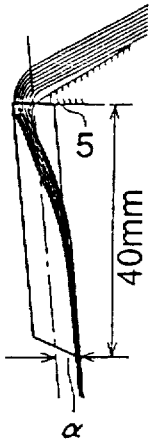
Figures 1, 2C:
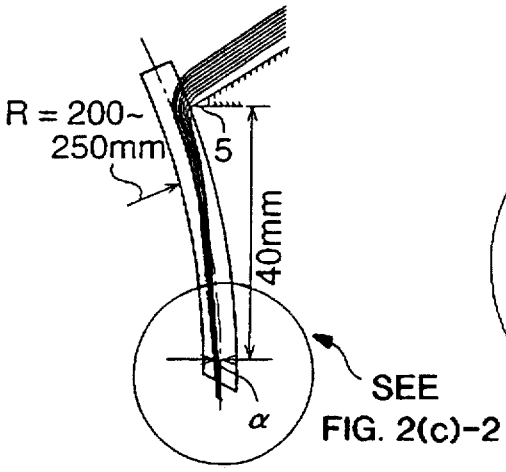
Figures 2, 2C:
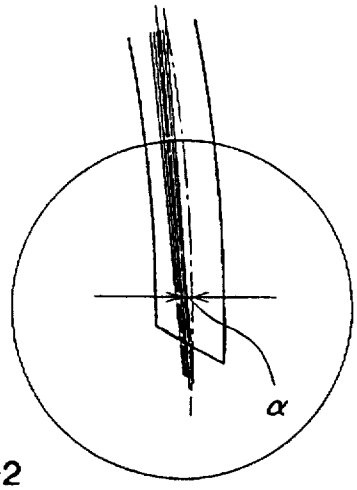

The edge guide 6 includes a straight bar-shaped one tilted toward coater die 3 as shown in FIG. 2 (*b*) and a bar-shaped one curved to be a shape of a circular arc whose average radius is 200–250 mm as shown in FIG. 2 (*c*). Incidentally, what is shown in FIG. 2 (*a*) is a conventional one that is a straight and bar-shaped edge guide arranged vertically.

There will be explained as follows concerning noticeable effects in terms of the state of the finishing of coating exhibited in the case wherein the edge guides shown in FIGS. 2 (*b*) and 2 (*c*) were used, compared with an occasion where a conventional edge guide shown in FIG. 2 (*a*) was used.

EXAMPLES

Example 1

Fundamental conditions of the experiment

Composition of each coating solution: Aqueous solution of 7% gelatin adjusted to 30 cp by thickening agents Layer structure: 2–10 layers Curtain height: 30–300 mm Coating speed: 100–400 m/min.

Curtain layer width: 300 mm

Measurement of teapot amount

Figure 3:
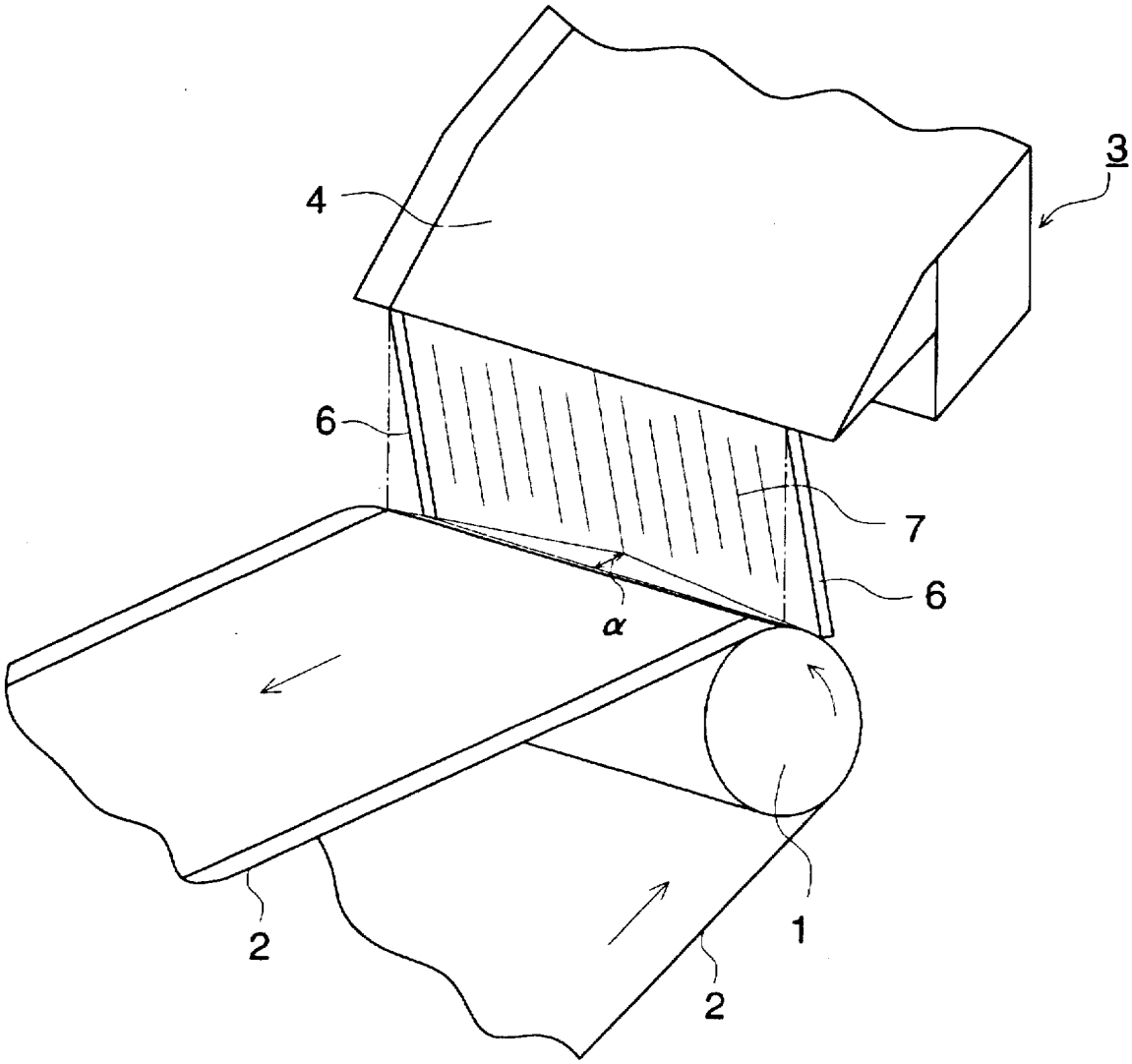
FIG. 3 is a perspective view showing the relation between various edge guides and curtain layer forming.

As shown in a perspective view of FIG. 3, a distance between a central portion in the width of a curtain layer on its bottom end and a point of contact between the curtain layer and an edge guide at both ends in the direction that is perpendicular to the lateral direction of the curtain layer and is horizontal was measured as deviation width of teapot α (mm). In the measurement, it was assumed that α takes a plus sign when the central portion on the bottom end of the curtain layer is positioned between a point of contact for both the curtain layer and the edge guide at both ends and coater die 3, while α takes a minus sign when that central portion is positioned between a point of contact for both the curtain layer and the edge guide at both ends and back roller 1. Edge guide used: (shown in FIGS. 2 (*a*), 2 (*b*) and 2 (*c*))

(a) straight and bar-shaped edge guide provided vertically: shown by ▲

(b) straight and bar-shaped edge guide provided obliquely: shown by ●

(c) Edge guide in a shape following teapot phenomenon: shown by ■

Measurement of a rate of thick layer on edge area

Dried thick layer area A and normal area B both of a coated product were measured, and A/B×100 was calculated for obtaining the rate of thick layer on edge area.

evaluation

A: Possible to coat

B: Curtain layer breakage after start of coating

C: Curtain layer breakage

Figure 4:
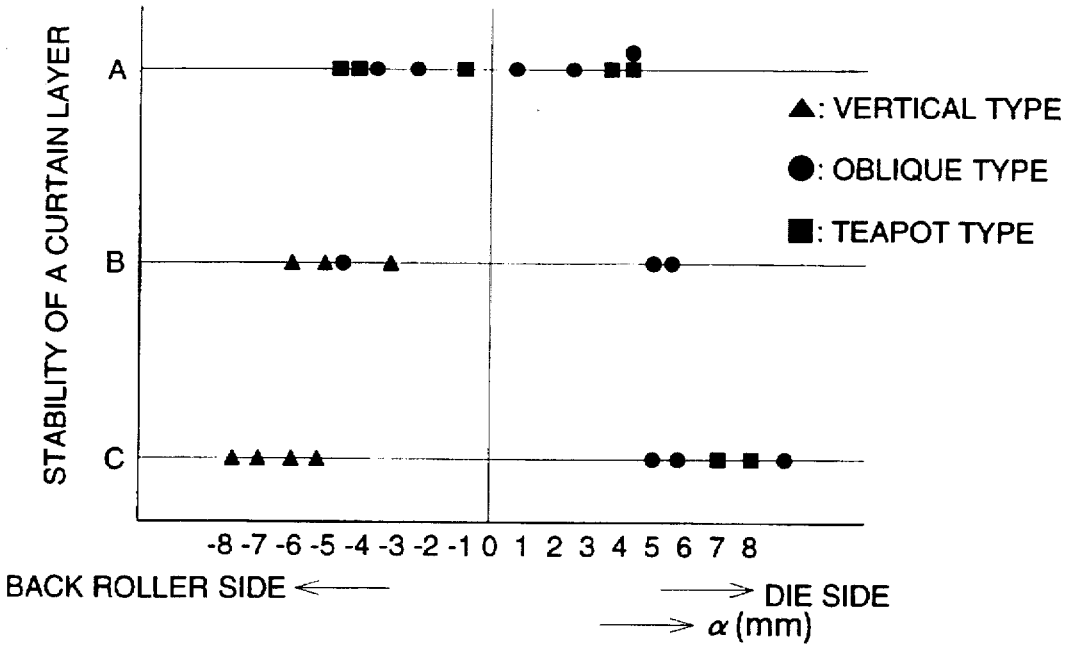
FIG. 4 represents a graph showing the relation between deviation width of teapot α and stability of a curtain layer.

First, the relation between deviation width of teapot α and stability of a curtain layer is like one shown in a graph of FIG. 4.

As is clear from FIG. 4, it is understood that when a bar-shaped edge guide of an oblique type and an edge guide following a teapot phenomenon are used, stability of a curtain layer can be obtained when an absolute value of α is not more than 4 mm, but the curtain layer becomes unstable when an absolute value of α is not less than 4 mm. However, it is also understood that the curtain layer becomes unstable even when an absolute value of α is not more than 4 mm, if a bar-shaped edge guide of a vertical type is used.

Figure 5:
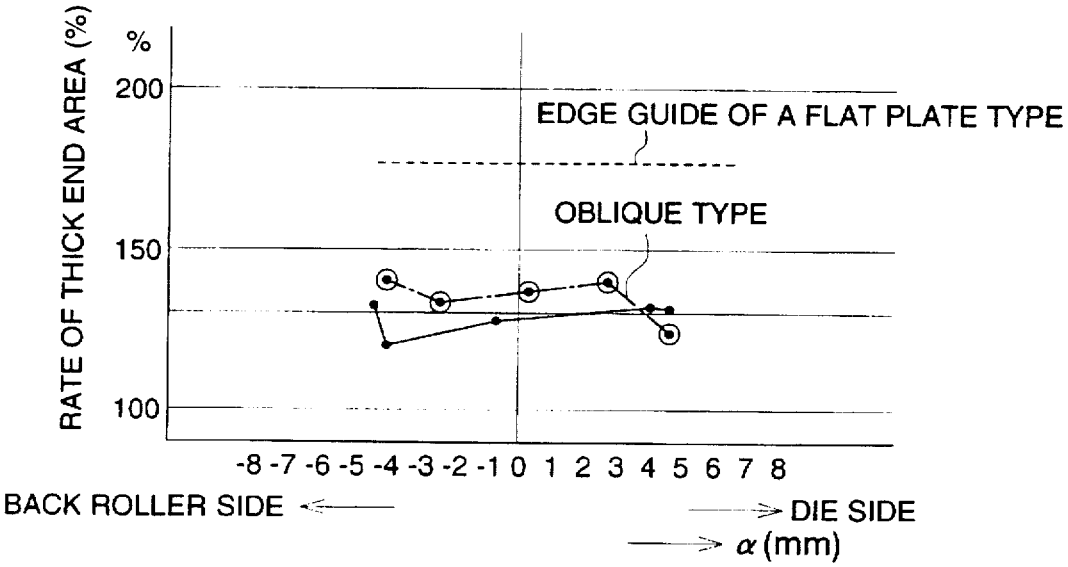
FIG. 5 represents a graph showing the relation between deviation width of teapot α and a rate of thick layer on edge area.

Further, the relation between deviation width of teapot α and a rate of thick layer on edge area of a curtain layer comes to one like a graph shown in FIG. 5.

A graph in FIG. 5 makes the following clear, when a bar-shaped edge guide of an oblique type and an edge guide following a teapot phenomenon are used, the rate of thick layer on edge area of a curtain layer is about 130%, which means that the thick layer is improved remarkably. The rate of thick layer on edge area at such level does not cause any load for drying, and it is considered to be in a range allowable in terms of quality as a product. However, when a conventional edge guide of a flat plate type is used, the rate of thick layer on edge area of a curtain layer goes up to about 180%, which causes heavy load for drying, and there is presented a phenomenon that a conveyance path in a drying section is contaminated by insufficient drying, and product quality in coating is extremely impeded.

Figure 6:
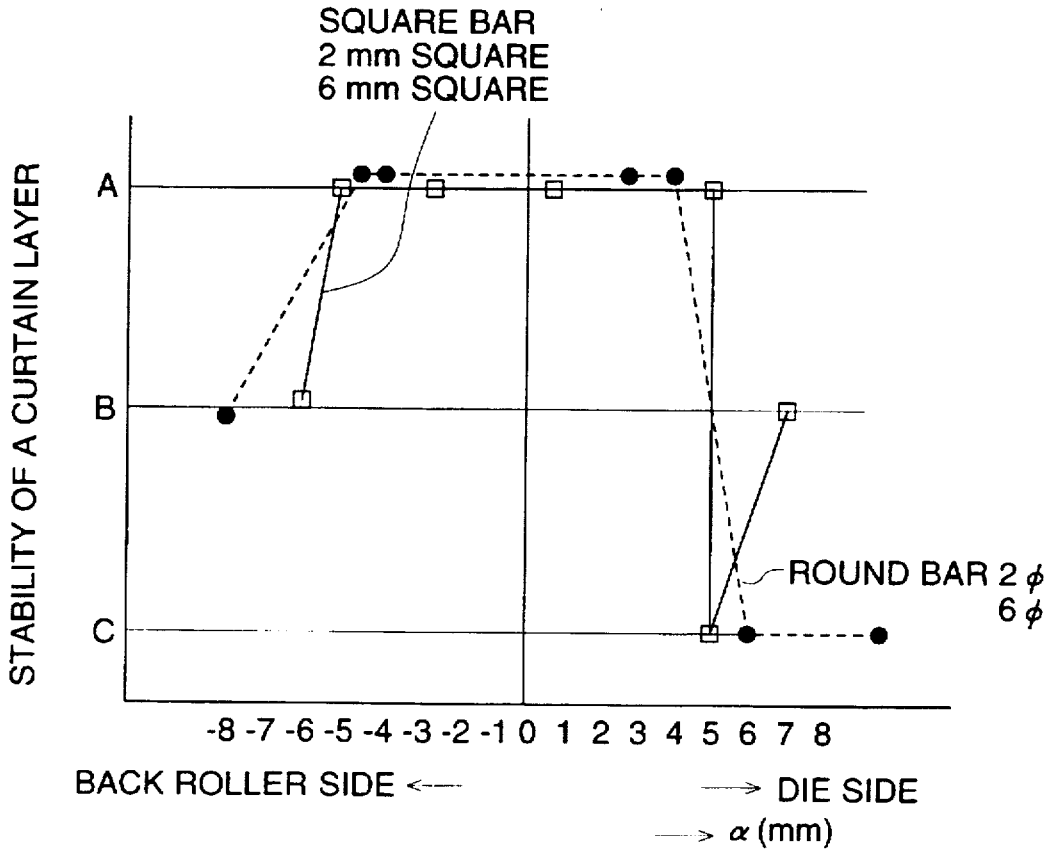
FIG. 6 represents a graph showing the relation between deviation width of teapot α and stability of a curtain layer effected when various edge guides of an oblique type are used.
Figure 7:
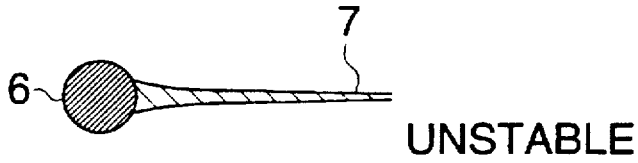
FIG. 7 (A) PRIOR ART
FIGS. 7(A), 7(B) and 7(C) each represents a cross sectional view of a conventional edge guide and a curtain layer formed on the conventional edge guide.
Figure 7:
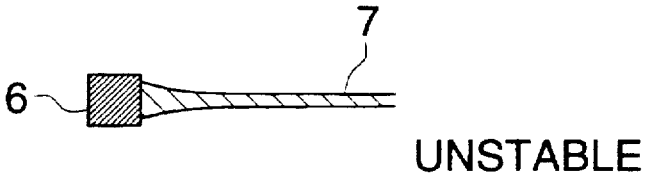
FIG. 7 (B) PRIOR ART
Figure 7:
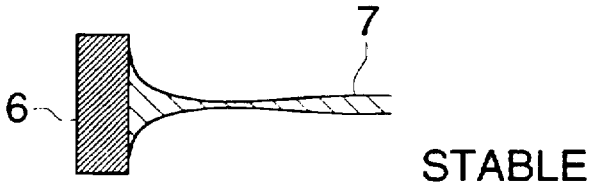
FIG. 7 (C) PRIOR ART

In the example shown in a graph of FIG. 6, the relation between deviation width of teapot α and stability of a curtain layer is plotted under the same conditions as in the foregoing except that a round bar of 6 mm in diameter and that of 2 mm in diameter as well as a square pillar of 6 mm in section side and that of 2 mm in section side are used as a bar-shaped edge guide of an oblique type. Even in this example, no difference was observed in 4 kinds of edge guides each having different shape and dimension, and results in this case were mostly the same as those in the example shown in the graph of FIG. 4.

The invention has made it possible to provide a curtain coater capable of coating on both edge areas extremely uniformly while forming a stable curtain layer, and also capable of manufacturing light-sensitive materials which are of high quality, high yield and low load for drying.

What is claimed is:

1. A method of coating a substrate comprising discharging a coating solution, which solution includes a light sensitive material, from a coater die;

forming a curtain layer of said coating solution by causing said coating solution to fall from a die lip of said coater die;

forming a curtain layer between two edge guides by causing each edge of said curtain layer to contact one of said edge guides, wherein a shape of a cross section taken perpendicular to the vertical axis of each of said edge guides from a top end at the die lip to a bottom end is round, wherein each of said edge guides is inclined toward said coater die and the bottom of each said edge guide is located nearer said coater die in relation to a vertical line from said die lip; and wherein each of said edge guides is formed in a cross sectional shape taken perpendicular to the horizontal of a curtain layer which is formed when said coating solution falls from said die lip in the absence of said edge guides; and coating a substrate with said coating solution by conveying said substrate at the downstream edge of said curtain layer, such that said curtain layer falls onto the substrate to form a coating.

2. The method of claim 1, wherein a discharging amount of said coating solution from said coater die is not less than 2 cc/sec/cm.

3. The method of claim 1, wherein said cross sectional shape from said curtain layer is a teapot phenomenon shape.

4. The method of claim 1 wherein a distance between a central portion of said curtain layer on its bottom end and a point of contact between said curtain layer and said edge guides are is not more than ±4 mm in a direction perpendicular to the lateral direction of said curtain layer and is horizontal.

5. The method of claim 1 wherein each of said edge guides is curved.

6. An apparatus for coating a substrate comprising a coater die for discharging a coating solution which solution includes a light sensitive material;

two edge guides for contacting each edge of a curtain layer of said coating solution, said curtain layer formed by causing said coating solution to fall from a die lip of said coater die;

wherein a shape of a cross section taken perpendicular to the vertical axis of each of said edge guides from a top end at the die lip to a bottom end is round, wherein each of said edge guides is inclined toward said coater die and the bottom of each said edge guide is located nearer said coater die in relation to a vertical line from said die lip; and wherein each of said edge guides is formed in a cross sectional shape taken perpendicular to the horizontal of a curtain layer which is formed when said coating solution falls from said die lip in the absence of said edge guides.

7. The apparatus of claim 6 wherein said cross sectional shape is a teapot phenomenon shape.

* * * * *